United States Patent [19]

Jones

[11] 4,092,029

[45] May 30, 1978

[54] CHANCE CONTROLLED COUNTING GAME

[76] Inventor: David L. Jones, 4341 Cole Pl., Caddo Parish, Shreveport, La. 71109

[21] Appl. No.: 703,977

[22] Filed: July 9, 1976

[51] Int. Cl.[2] ..... A63F 3/00

[52] U.S. Cl. ..... 273/271

[58] Field of Search ..... 273/135 R, 135 AA, 135 B, 273/146; 35/31 R, 31 F, 31 G, 32, 33

[56] References Cited

U.S. PATENT DOCUMENTS

| | | | |
|---|---|---|---|
| 76,572 | 4/1868 | Wight | 273/135 R UX |
| 481,859 | 8/1892 | George | 273/135 R |
| 695,303 | 3/1902 | Graham | 273/135 AA |
| 1,099,009 | 6/1914 | Bennett | 35/33 |
| 1,302,805 | 5/1919 | Jentz | 273/135 AA |
| 1,750,620 | 3/1930 | Brittingham | 35/31 F UX |
| 2,511,092 | 6/1950 | Ashleman | 273/135 AA UX |
| 3,545,101 | 12/1970 | Fike | 35/31 F |

*Primary Examiner*—Anton O. Oechsle

[57] ABSTRACT

A counting game comprising a playing board for each player, marker chips, first and second dice, and a counting rack including a horizontal bar with slidable elements thereon for each player. The playing boards each have a sequentially numbered array of playing spaces and a finish space. The players in turn throw the first die, place the thus indicated number of chips in sequentially numbered spaces on their respective boards and cumulatively record the number of placed chips on their respective counting racks by sliding the elements from one end of the bar to the other. The second die is thrown when all of the elements on a respective rack have been slid from one end of the bar to the other. The second die in turn directs that a selected number of chips be added to or subtracted from a player's board. The game ends when one player succeeds in placing chips in all of the sequentially numbered spaces and finish space without having any of the slidable elements moved from the one end of his counting rack.

1 Claim, 7 Drawing Figures

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |
| 81 | 82 | 83 | 84 | 85 | 86 | 87 | 88 | 89 | 90 |
| 91 | 92 | 93 | 94 | 95 | 96 | 97 | 98 | 99 | 100 |
| 101 | 102 | 103 | 104 | 105 | | | | | |

FIG. 1
| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |
| 81 | 82 | 83 | 84 | 85 | 86 | 87 | 88 | 89 | 90 |
| 91 | 92 | 93 | 94 | 95 | 96 | 97 | 98 | 99 | 100 |
| 101 | 102 | 103 | 104 | 105 | | | | | |
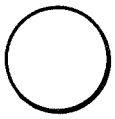
FIG. 2
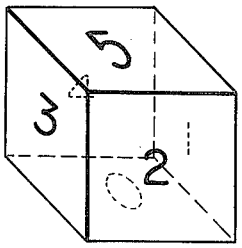
FIG. 3

CHANCE CONTROLLED COUNTING GAME

BRIEF SUMMARY

The new invention is a game. The title of the game is Chance Controlled Counting Game. It is a game designed for the following purposes:

1. To teach and improve one's skills in counting.
2. By playing the game, a player becomes familiar with numbers from −5 (negative five) through 105.
3. To teach and improve one's skills in addition and subtraction.
4. To teach the meaning of positive numbers.
5. To teach the meaning of negative numbers.
6. To teach the meaning of zero.
7. To provide an element of fun and competition in the process of learning as outlined in 1 through 6 above.
8. To provide fun and recreational activity for anyone who plays the game.

PROBLEMS WHICH GAME IS DESIGNED TO OVERCOME

One problem which this game is designed to overcome is that of boredom in the educational process. By playing this game, one may develop the skills and knowledge outlined above.

DESCRIPTION OF DRAWINGS

FIG. 1 is the playing board. Each player has a playing board.

FIG. 2 is the playing chip. Each player has 105 playing chips.

FIG. 3 is the playing cube. The game has only one playing cube.

DETAILED DESCRIPTION OF GAME

Figure 4A:
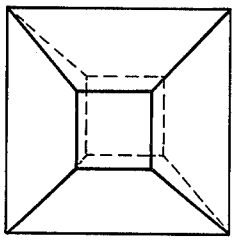
FIGS. 4A, 4B and 4C are the bonus decagon. The game has only one bonus decagon.

Parts of the Game.

a. The Playing Board (FIG. 1)

The game has two playing boards. (Four playing boards are included in games designed to accomodate three or four players).

Each playing board is 10 inches wide, and 11 inches long. It is divided into 110 squares. Each square is 1 inch.

The first 105 squares are numbered in sequence from 1 through 105, beginning with the first square in the upper left hand corner. The last five squares, (106–110), are left blank. These blank squares are not used in the game.

The squares numbered 101–105 are known as the gray area. This area is used in the game only when dictated by Example 6 and Example 8 under the section marked "How The Game Is Won."

b. The Playing Chips (FIG. 2)

The game has 210 playing chips. (420 playing chips are included in games designed to accomodate three or four players). Each player receives 105 playing chips.

c. The Throwing Cube (FIG. 3)

The game has one throwing cube. Each side of the throwing cube is 1 square inch. Eash side has a number.

Figure 4B:
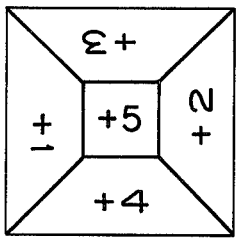
Figure 4C:
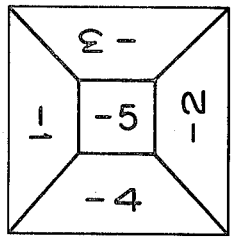

The numbers range from zero through five. Each number is used on the playing cube only one time.

d. The Bonus Decagon (FIG. 4)

The game has one bonus decagon. It has 10 sides. The 10 sides are numbered with positive numbers and negative numbers.

There are five positive numbers:

+1, +2, +3, +4, +5

Figure 5:
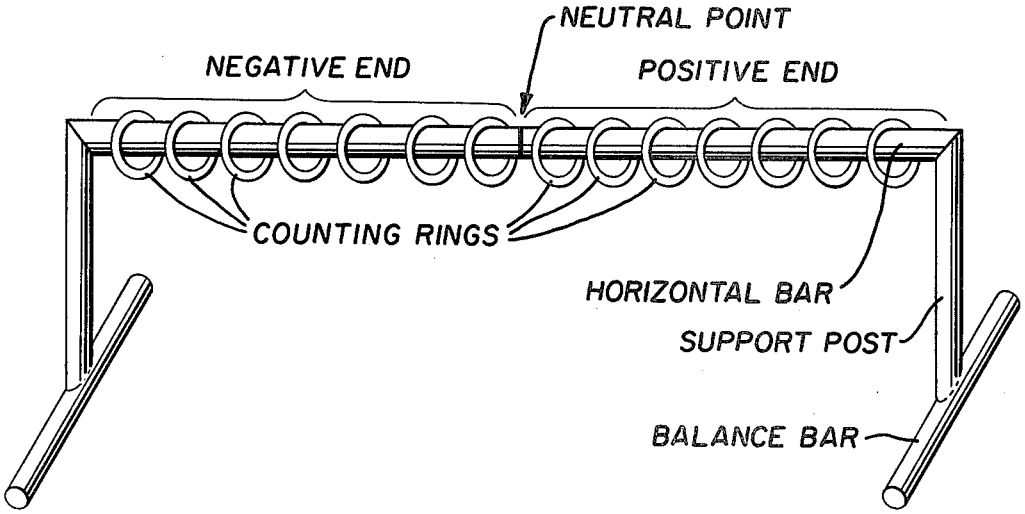
FIG. 5 is the counting rack. Each player has a counting rack.

There are five negative numbers:

−1, −2, −3, −4, −5 e. The Counting Rack (FIG. 5)

The game has two counting racks. (Four counting racks are included in games designed to accomodate three or four players).

Each counting rack consists of a horizontal bar, 10 inches long, supported by a parallel post on each end. Each parallel post is 6 inches long. Its base is attached to a balance bar 2½ inches long.

There are 14 counting rings on each counting rack. The counting rings fit loosely over the horizontal bar. The counting rings can easily be moved from one end of the horizontal bar to the other.

The horizontal bar is divided into two equal parts. It has a positive end and a negative end. The positive end is painted black. The negative end is painted red. The postive end is on the right. The negative end is on the left.

GETTING READY TO PLAY GAME

1. Each player selects a playing board.
2. Each player selects a counting rack. After selecting the counting rack, all of the counting rings are moved to the negative end of the horizontal bar.
3. Each player selects 105 playing chips

HOW TO DECIDE WHO PLAYS FIRST

To determine who plays first, each player throws the playing cube once. The player who throws the highest number plays first.

HOW TO START THE GAME

1. To start play, the player who plays first, throws the playing cube once. He then places as many playing chips on his playing board as indicated by the number on top of the playing cube.

EXAMPLE 1. If the playing cube stops with a three on top, the player places three playing chips on his playing board in the sections marked 1, 2, and 3.

2. After placing the three playing chips on the playing board, the player turns to the counting rack and moves three counting rings from the negative end to the positive end. Then, the next player plays.

3. If the playing cube stops with the zero on top, the player does not place any playing chips on the playing board. He does not move any of the counting rings to the positive end of the counting rack. He has lost his turn to play. The next player plays.

THE BONUS DECAGON

1. As soon as a player has moved at least 10 counting rings to the positive end of the counting rack, he has earned the right to throw the bonus decagon.

2. The player throws the bonus decagon once. He either adds or subtracts the number of playing chips on the playing board as indicated by the number on top of the decagon.

EXAMPLE 2. If the bonus decagon stops with a +5 on top, the player adds five more playing chips to his playing board. (He has gained five additional places).

EXAMPLE 3. If the bonus decagon stops with a −5 on top, the player must remove five of his playing chips fron his playing board. (He has lost five places).

3. After adding or subtracting the playing chips according to the dictates of the bonus decagon, the player must transfer 10 of the counting rings from the positive end to the negative end of the counting rack.

4. If there are more than 10 counting rings on the positive end of the counting rack, the player leaves the excess over 10 on the positive end.

EXAMPLE 4. If a player has 13 counting rings on the positive end of the counting rack, he transfers 10 of them back to the negative end after throwing the bonus decagon. Three rings are left on the positive end of the counting rack.

5. Play continues with the playing cube until one player again has at least 10 counting rings on the positive end of the counting rack. He again throws the bonus decagon as explained above.

HOW THE GAME IS WON

1. The aim of the game is to reach 100. Therefore, the first player to reach 100 on his playing board wins the game.

2. No game is complete, or won, even if a player reaches 100 by throwing the playing cube if the throw causes him to have as many as 10 counting rings on the positive end of the counting rack. Although he has reached 100 he still must throw the bonus decagon as explained above.

EXAMPLE 5. Suppose, a player already has 95 on his playing board. And, he has six counting rings on the counting rack. He then throws the playing cube at his turn to play and gets a +5. After adding five playing chips, he now has 100. But, the game is not over. The player must also move five more counting rings to the positive end of the counting rack. This gives him a total of 11 counting rings on the positive end. Therefore, he must throw the bonus decagon.

EXAMPLE 6. In throwing the bonus decagon, if it stops with a +5 on top, the player adds five more playing chips in the gray area marked 101–105. Then the game is won. He has reached 100 permanently. (When he reaches 100 and does not have to throw the bonus decagon. Or, when, after throwing the bonus decagon, he still has at least 101). The player has won the game.

EXAMPLE 7. If the bonus decagon stops with a −5 on top, the player must remove five of his playing chips from his playing board. This leaves him only 95. In this case, he has reached 100 temporarily. The game is not over. Play continues until a player reaches 100 permanently.

3. A player will use the gray area as outlined in Examples 6 and 7 above. Also, he may use the gray area after throwing the playing cube.

EXAMPLE 8. Suppose, a player has 97 on his playing board. And, he has only three counting rings on the positive end of the counting rack. At his turn to play, he throws a four. He places four playing chips on his playing board in the section marked 98–101. His new total is 101. After moving four more counting rings to the positive end of the counting rack, he still has only seven on the positive end. He does not throw the bonus decagon. He has reached 100 permanently. The game is won.

I claim:

1. A counting game comprising a playing board for each player, each playing board having a sequentially numbered array of playing spaces including at least one finish space, a plurality of marker chips for each player equal in number to the number of playing spaces on each board, a first die having a number on each face thereof for randomly determining for each player during his successive turn how many chips he is to place on sequentially numbered spaces on his playing board, a counting rack for each player, said counting racks each comprising a horizontal bar with slidable elements thereon which are initially positioned adjacent one end of the bar, a second die having selected positive and negative numbers on the respective faces thereof, whereby each player, in turn, throws the first die, places chips on successive sequentially numbered spaces on his board equal in number to the topmost number of the thrown die and moves an equal number of slidable elements away from their initial positions, and when a selected number of elements have been so moved, the player being allowed to throw said second die and add or remove chips from the board in accordance with the topmost positive or negative number appearing on said second die, said game continuing until one player succeeds in covering his finish space or spaces and not having said selected number of elements moved from their initial positions.

* * * * *